US010487721B2

(12) United States Patent
Lundgren et al.

(10) Patent No.: US 10,487,721 B2
(45) Date of Patent: Nov. 26, 2019

(54) TWO-STROKE INTERNAL COMBUSTION ENGINE

(71) Applicant: HUSQVARNA AB, Huskvarna (SE)

(72) Inventors: Alexander Lundgren, Huskvarna (SE); Joel Berneklev, Göteborg (SE); Tommy Shoug, Göteborg (SE)

(73) Assignee: HUSQVARNA AB, Huskvarna (SE)

( * ) Notice: Subject to any disclaimer, the term of this patent is extended or adjusted under 35 U.S.C. 154(b) by 37 days.

(21) Appl. No.: 15/562,130

(22) PCT Filed: Mar. 31, 2015

(86) PCT No.: PCT/EP2015/056948

§ 371 (c)(1),
(2) Date: Sep. 27, 2017

(87) PCT Pub. No.: WO2016/155780

PCT Pub. Date: Oct. 6, 2016

(65) Prior Publication Data

US 2018/0080369 A1 Mar. 22, 2018

(51) Int. Cl.
*F02B 25/06* (2006.01)
*F02M 35/10* (2006.01)
(Continued)

(52) U.S. Cl.
CPC ..... *F02B 25/06* (2013.01); *F02B 25/22* (2013.01); *F02B 75/02* (2013.01); *F02D 9/02* (2013.01);
(Continued)

(58) Field of Classification Search
CPC .... F02B 25/06; F02B 75/02; F02B 2075/025; F02D 9/02
See application file for complete search history.

(56) References Cited

U.S. PATENT DOCUMENTS 5,322,043 A * 6/1994 Shriner ..... F02B 17/00 123/295
5,345,897 A * 9/1994 Linder ..... F01L 1/446 123/65 A
(Continued)

FOREIGN PATENT DOCUMENTS

DE 102006024078 A1 11/2007
JP 56110518 A 9/1981
JP 2003222055 A 8/2003

OTHER PUBLICATIONS

International Search Report and Written Opinion for International Application No. PCT/EP2015/056948 dated Dec. 17, 2015.
(Continued)

*Primary Examiner* — Joseph J Dallo
*Assistant Examiner* — Kurt Philip Liethen
(74) *Attorney, Agent, or Firm* — Burr Forman LLP

(57) ABSTRACT

An internal combustion engine (10), including a cylinder (15) with a cylinder wall (12) defining a combustion chamber (32), a piston (13) reciprocally disposed within the combustion chamber (32) a crankcase (16) including a crankshaft (11) rotatably disposed therein, the piston (13) being connected to the crankshaft (11) by a connecting rod (17), a first scavenger duct (3) extending between the combustion chamber (32) and the crankcase (16), the first scavenger duct (3) including a top port (31*a*) and a bottom port (31*b*), a fuel and air inlet channel (22) in fluid communication with the crankcase (16) by way of a piston ported fuel and air inlet port (23) so that the fuel and air inlet channel (22) delivers a fuel and air mixture to the crankcase (16), and an airhead channel (6) in fluid communication with the first scavenger duct (3) by way of a first piston ported air inlet port (7), characterized in that the fuel and air inlet channel (22) is in fluid communication with the airhead
(Continued)

channel (6) so that the fuel and air mixture is combinable with the air flow from the airhead channel (6).

16 Claims, 3 Drawing Sheets

(51) Int. Cl.

| | |
|---|---|
| ***F02M 35/108*** | (2006.01) |
| ***F02B 25/22*** | (2006.01) |
| ***F02B 75/02*** | (2006.01) |
| ***F02D 9/02*** | (2006.01) |

(52) U.S. Cl.
CPC .... *F02M 35/108* (2013.01); *F02M 35/10196* (2013.01); *F02B 2075/025* (2013.01); *F02D 2009/0252* (2013.01); *F02M 35/1017* (2013.01)

(56) References Cited

U.S. PATENT DOCUMENTS

| | | | | |
|---|---|---|---|---|
| 6,135,428 | A * | 10/2000 | Schliemann | B27B 17/00 261/35 |
| 7,730,857 | B2 | 6/2010 | Geyer et al. | |
| 8,122,861 | B2 * | 2/2012 | Yuasa | F02B 25/14 123/65 V |
| 2002/0043227 | A1 * | 4/2002 | Carlsson | F02B 25/14 123/73 PP |
| 2004/0012102 | A1 * | 1/2004 | Gerhardy | F02B 25/14 261/38 |
| 2010/0242904 | A1 | 9/2010 | Hoche et al. | |
| 2012/0152216 | A1 * | 6/2012 | Grether | F02B 25/20 123/65 P |
| 2013/0047953 | A1 * | 2/2013 | Uenoyama | F02M 35/024 123/198 E |

OTHER PUBLICATIONS

International Preliminary Report on Patentability for International Application No. PCT/EP2015/056948 dated Jun. 26, 2017.

* cited by examiner

TWO-STROKE INTERNAL COMBUSTION ENGINE

TECHNICAL FIELD

Example embodiments generally relate to internal combustion engines and, more particularly, relate to a stratified charged two-stroke engine that is configured for improved starting in both hot and cold engine conditions.

BACKGROUND

In an attempt to increase the fuel efficiency and reduce an emission of scavenging two-stroke engines, it is known to direct fresh air from an airline to the top end of the transfer, or scavenging, ducts during regular engine operations. The fresh air acts as a buffer between the combustion gasses that are to be exhausted and the fuel and air mixture that is initially directed into the crankcase from the fuel and air inlet channel, which ultimately enters the combustion chamber through the scavenger ducts in preparation for the subsequent combustion event. In short, the fresh air directed to the scavenger ducts is first to enter the combustion chamber as the piston moves from the top dead center position to the bottom dead center position, rather than the fuel and air mixture from the crankcase. As such, any initial mixing that may occur in the combustion chamber with the combustion gasses is with the fresh air from the scavenger ducts rather than the fuel and air mixture. This improves fuel efficiency as the amount of any unspent fuel that may exit the combustion chamber with the combustion gasses during the exhaust operations due to mixing is reduced. However, the introduction of fresh air into the scavenger ducts during normal operations also means that during start-up, the combustion chamber initially receives fresh air from the scavenger ducts rather than the fuel and air mixture from the crankcase. As such, the fuel and air mixture that is provided to the combustion chamber during start-up of the engine will be leaner than desired for efficient engine start-up. As such, the operation of such two-stroke combustion engines is often complicated by the use of a choke, as is known, at start-up to make the fuel and air mixture temporarily richer. Those issues are typically encountered in those two-stroke engines having independent fresh air and fuel and air mixture channels. Alternatively, an operator has to pull a starting rope a number of times (at least 3-4 times at a cold start of the engine) to allow a sufficient amount of the fuel and air mixture from the crank house via the scavenging channels to reach the combustion chamber in a such concentration of fuel that would be enough for the ignition. Therefore, it is desirable to have a two-stroke engine in which easier and quicker to start, especially for the cold start, that allows to create a richer and easier to ignite the fuel and air mixture concentration in the combustion chamber at the engine start, although fresh air is provided to the scavenging ducts during normal operations, the fresh air might not be provided during the engine start-up.

The present invention recognizes and addresses considerations of prior art constructions and methods.

BRIEF SUMMARY OF SOME EXAMPLES

Some example embodiments may provide for improved start-up operations for an internal combustion engine for hand-held equipment. In this regard, for example, some embodiments may provide for channeling a portion of the fuel and air mixture provided for the engine's carburetor directly into the scavenger ducts rather than by way of the crankcase, as is known in the prior art. In one example embodiment, a scavenging two-stroke internal combustion engine comprises a cylinder with a cylinder wall defining a combustion chamber. A piston is reciprocally disposed within the cylinder. A crankcase includes a crankshaft rotatably disposed therein. The piston is connected to the crankshaft by a connecting rod. At least one scavenger duct extends between the combustion chamber and the crankcase. The scavenger duct includes a top port and a bottom port. A fuel and air mixture inlet channel is in fluid communication with the crankcase by way of a fuel and air inlet port so that the fuel and air mixture inlet channel delivers a fuel and air mixture to the crankcase. An airhead channel is opened into the cylinder; the airhead channel comprises an air inlet valve. The airhead channel and the fuel and air mixture channel are formed separately one from another. At least at start of the engine, a fluid communication is established between the fuel and air mixture inlet channel and the combustion chamber so that at least a portion of the fuel and air mixture is fed into the combustion chamber via the scavenging channel(s) or the airhead channel so as to create a rich mixture into the combustion chamber that is easier to ignite. The piston defines at least one flow path on its outer circumference that extends radially inward from its outer surface and provides the fluid communication between the fuel and air inlet channel and the combustion chamber as the piston reciprocates within the cylinder. At start of the engine, the air inlet valve is closed. A crossover channel extends between the fuel and air inlet channel and the airhead channel so that the fuel and air inlet channel is in fluid communication with the combustion chamber and this channel delivers the fuel and air mixture to the combustion chamber via the airhead channel. An idle start valve is disposed in the crossover channel; the idle start valve is being movable between an open position in which the fuel and air inlet channel is in fluid communication with the airhead channel and a closed position in which the fuel and air inlet channel is isolated from the airhead channel. The idle start valve is open only during the start of the engine, when the air inlet valve is in the closed position. The crossover channel is formed in the cylinder wall.

A method of an effective starting an internal scavenging two-stroke combustion engine including a cylinder with a cylinder wall defining a combustion chamber, a crankcase, and a piston disposed in the cylinder, comprising the steps of providing a fuel and air mixture inlet channel in fluid communication with the crankcase; providing an airhead channel in fluid communication with the cylinder interior, the airhead channel is formed separately from the fuel and air mixture channel; and establishing at least at start of the engine a fluid communication between the air and fuel mixture channel and the combustion chamber so that at least a part of the fuel and air mixture will be fed from the fuel and air mixture inlet channel into the combustion chamber either via the recess(-es) made on the cylindrical circumference of the piston forming the channel or via the airhead inlet channel through the crossover channel. The recess(-es) formed in an outer surface or circumference of the piston for the fluid communication between the air and fuel mixture channel and the combustion chamber. The crossover channel is formed in the cylinder wall for the fluid communication between the fuel and air mixture inlet channel and the combustion chamber via the airhead channel. The idle start valve (42) is provided in the crossover channel, the valve is open only during the start of the engine, when the air inlet valve is in the closed position.

The accompanying drawings, which are incorporated in and constitute a part of this specification, illustrate one or more embodiments of the invention and, together with the description, serve to explain the principles of the invention

BRIEF DESCRIPTION OF THE SEVERAL VIEWS OF THE DRAWINGS

Figure 1:
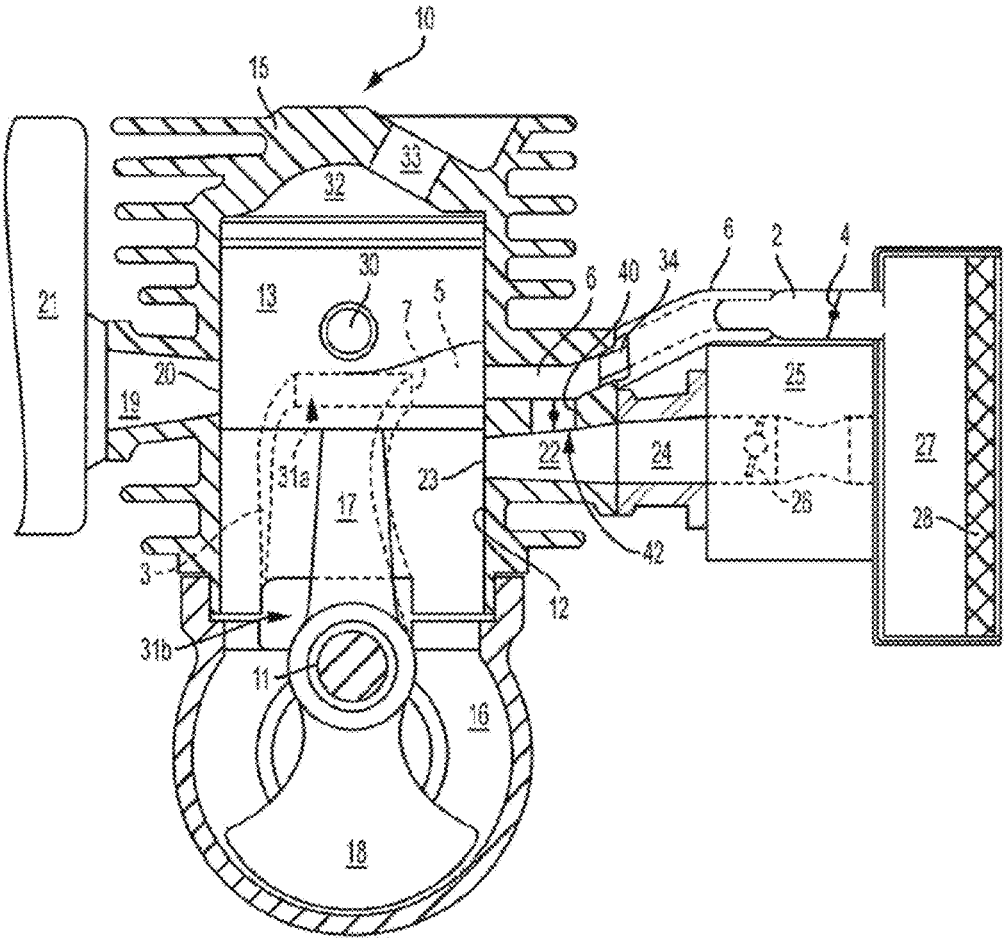
Figure 2:
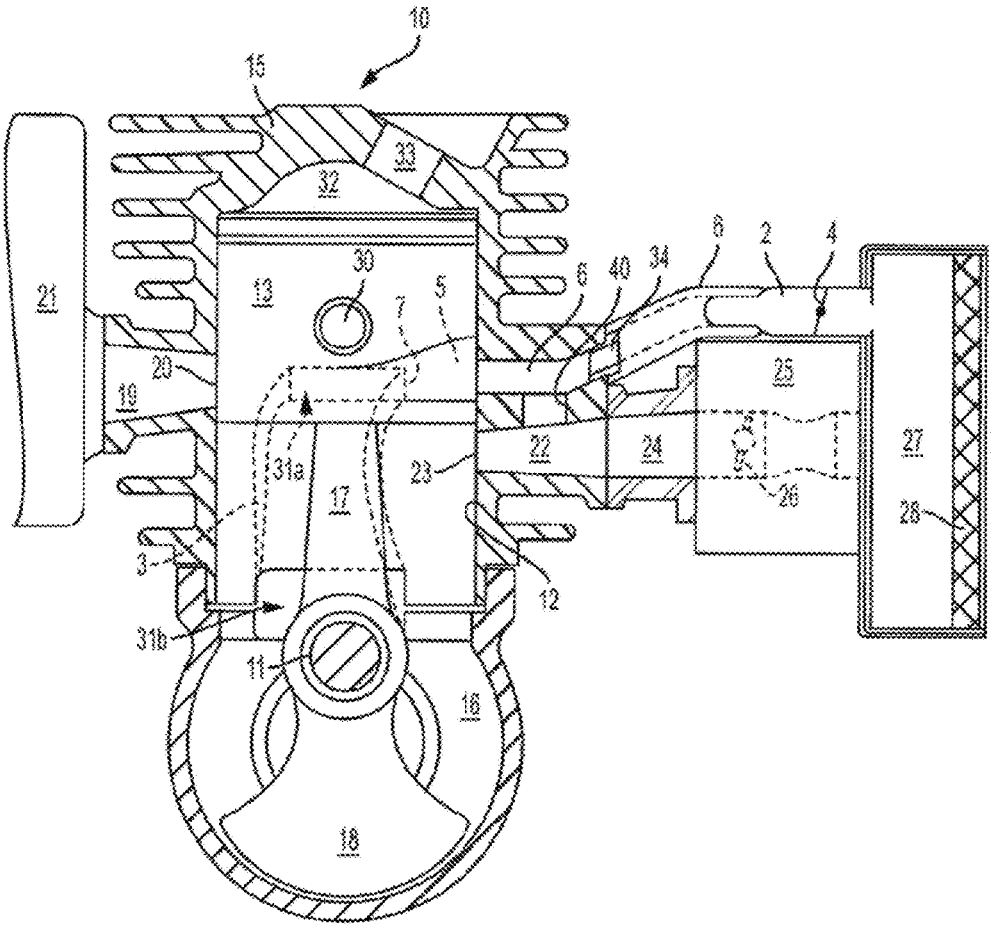
Figure 3:
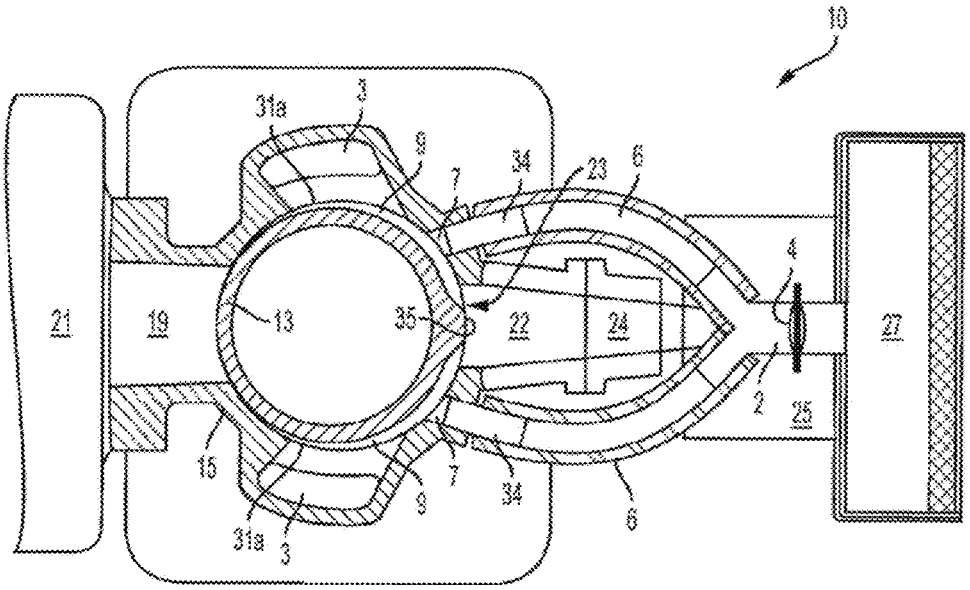

Having thus described the invention in general terms, reference will now be made to the accompanying drawings, which are not necessarily drawn to scale, and wherein:

FIG. 1 is a cross-sectional side view of a two-stroke internal combustion engine according to an example embodiment of the present disclosure;

FIG. 2 is a cross-sectional side view of a two-stroke internal combustion engine according to an alternate, second embodiment of the present disclosure;

FIG. 3 is a top cross-sectional view of a two-stroke internal combustion engine according to an alternate, third embodiment of the present invention.

Repeat use of reference characters in the present specification and drawings is intended to represent same or analogous features or elements of the invention according to the disclosure.

DETAILED DESCRIPTION

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout. Furthermore, as used herein, the term "or" is to be interpreted as a logical operator that results in true whenever one or more of its operands are true. As used herein, operable coupling should be understood to relate to direct or indirect connection that, in either case, enables functional interconnection of components that are operably coupled to each other.

As indicated above, some example embodiments may provide for an internal scavenging two-stroke combustion engine that provides for improved starting of the engine under both hot and cold starting conditions. It should be appreciated that although an example embodiment will be shown and described illustrating a crank case scavenged internal combustion two-stroke engine that may be used in connection with hand held equipment such as, but not limited to, chainsaws, pole saws, trimmers, brush cutters, and/or the like, other applications for the disclosed two-stroke engine are also envisioned.

Referring now to the figures, FIG. 1 shows an internal combustion engine 10 configured according to the present invention. Preferably, engine 10 is a two-stroke engine and has two scavenging ducts 3, of which only one is shown in FIG. 1. The engine 10 includes a cylinder 15, a crankcase 16, a piston 13 with a connecting rod 17, and a crank mechanism 18 including a crankshaft 11. Furthermore, the engine 10 has an exhaust outlet 19 that has an exhaust port 20 that terminates in a muffler 21. The engine 10 has a fuel and air mixture inlet channel 22 that terminates at the cylinder 15 in a fuel and air mixture inlet port 23, the fuel and air mixture inlet channel 22 being connected to a carburetor 25 with a throttle valve 26 by means of an intermediate tube section 24. The carburetor 25 connects to an inlet muffler 27 with an air filter 28.

The piston 13 is connected to a connecting rod 17 by means of a piston pin 30. The piston 13 preferably has a planar top side without any recesses or other adaptations on its upper surface, so that it co-operates equally with the various cylinder ports wherever they are located around its periphery. Each scavenging duct 3 extends from a bottom scavenging port 31*b* formed in the sidewall of the crankcase 16 to a top scavenging port 31*a* found in the cylinder wall 12 of a combustion chamber 32 of the cylinder 15. The combustion chamber 32 includes an attachment point 33 for a spark plug, which is not shown.

An air inlet 2 is provided off of inlet muffler 27 and is equipped with a restriction valve 4 so that fresh air can be supplied as desired to the cylinder 15. The air inlet 2 is in fluid communication with the cylinder 15 by way of an airhead channel 6 that is connected thereto by connecting tube 34. In the cylinder wall 12, the airhead channel 6 divides into two branches referred to as connecting ducts 5. Connecting ducts 5 are each in fluid communication with the cylinder 12 by way of a corresponding air inlet port 7. Preferably, the air inlet ports 7 are shaped as cylindrical holes. In the present embodiment, the airhead channel 6 is formed by a portion of rubber hose that is external to the cylinder 15 and by a y-shaped portion that is formed in the cylinder wall 12 and includes the connecting ducts 5. Preferably, the airhead channel 6 terminates in at least two air inlet ports 7 in the engine's cylinder wall 12 to facilitate flow. The air inlet 2 draws air through the inlet muffler 27 so that cleaned fresh air is taken in and provided to the cylinder 15.

A crossover channel 40 extends between the airhead channel 6 and the fuel and air mixture inlet channel 22, thereby allowing a portion of the fuel and air mixture that flows through the fuel and air inlet channel 22 to enter the airhead channel 6. As shown, the crossover channel 40 is formed in the side wall of the cylinder 15. Note, however, in alternate embodiments, the crossover channel 40 may be formed externally to the side wall of the cylinder 15, such as by a section of rubber hose that is connected to the portion of the airhead channel 6 that is also formed by a section of rubber hose. An idle start valve 42 is disposed within the crossover channel 40 and is movable between an open position in which the fuel and air inlet channel 22 and the airhead channel 6 are in fluid communication with each other, and a closed position in which the two channels 6, 22 are isolated from each other. FIG. 1 shows the engine 10 in a start-up configuration. Specifically, the restriction valve 4 of the airhead channel 6 is in the closed position, the throttle valve 26 of the carburetor 25 is in the idle position, in which a desired amount of fuel and air mixture is allowed to enter the fuel and air mixture inlet channel 22, and the idle start valve 42 is in the open position so that a portion of the fuel and air mixture that is traveling through the fuel and air mixture inlet channel 22 toward the crankcase 16 is allowed to crossover into the airhead channel 6.

During engine 10 start-up, a flow path exists between each air inlet port 7 and the top scavenging port 31*a* of the respective scavenging duct 3. With the piston in the position shown, the fuel and air mixture that has entered the airhead channel 6 by way of the crossover channel 40 passes directly into the scavenging ducts 3 by way of the air inlet ports 7 and top scavenging ports 31*a*, rather than having to pass through the crankcase 16, as occurs in prior art engines. As such, the fuel and air mixture from the airhead channel 6 has a shorter distance to travel to enter the combustion chamber 32 than the fuel and air mixture that enters the crankcase 16 and, therefore, improves engine start-up.

During regular operation of the engine 10, i.e., after start-up, it is desirable that both of the transfer ducts 3 be entirely filled with fresh air from the airhead channel 6. As well, it is not desirable that the transfer ducts 3 be filled with the same fuel and air mixture that was previously supplied during start-up, since it will then potentially mixture with the combustion gases and be exhausted prior to combustion. As such, after start-up of the engine 10, during which the idle start valve 42 is open to allow fuel and air mixture to enter the airhead channel 6 from the fuel and air inlet channel 22, the idle start valve 42 is moved to the closed position so that fuel and air mixture no longer enters the airhead channel 6. As such, fresh air only is provided from airhead channel 6 to the scavenging ducts 3, thereby helping to prevent the undesirable mixing of fuel and air mixture for the crankcase 16 with the combustion gases in the combustion chamber 32 during exhaust operation. For simplicity of operation, the operation of the idle start valve 42 may be tied directly to that of the throttle valve 26, such as by a linkage (not shown), or in the alternative, it may be independently operated.

Referring now to FIG. 2, an alternate embodiment of an internal combustion engine 10 in accordance with the present invention is disclosed. As shown, the engine 10 differs only from the embodiment shown in FIG. 1 in that an idle start valve 42 is not provided in the crossover channel 40. As such, similar to the first embodiment, a portion of the fuel and air mixture that travels through the fuel and air inlet channel 22 toward the crankcase 16 will be allowed to pass through crossover channel 40 and into the airhead channel 6, to facilitate engine start-up operations. However, in the present embodiment, the airhead channel 6 remains in fluid communication with the fuel and air inlet channel 22 during regular engine operations, and cannot be isolated therefrom. Note, however, during regular engine operations in which a user moves the throttle valve 26 to a more open position, the restriction valve 4 of the airhead channel 6 also moves from its closed position to a more open position. Subsequently, fresh air begins to flow through the airhead channel 6, thereby raising the pressure therein. The increased pressure due to the flow of fresh air through the airhead channel 6, in essence, causes the flow of fuel and air mixture through the crossover channel to cease.

Referring now to FIG. 3 the present embodiment of the internal combustion engine 10 differs primarily from the previously discussed embodiments in that a crossover channel 40 is not provided between the fuel and air inlet channel 22 and the airhead channel 6. Rather, as best seen in FIG. 3, to allow a portion of the fuel and air mixture that travels through the fuel and air mixture inlet channel 22 to enter the scavenging ducts 3, a part of piston 13 material is removed, e.g. as a single piston recess 9 or a number of recesses corresponding to a number of the scavenging ducts 3, that allows the top scavenging ports 31*a* of the scavenging ducts 3 to be in fluid communication with the fuel and air inlet port 23 of the fuel and air inlet channel 22 simultaneously. Preferably, the piston 13 is simply manufactured, usually cast, including the piston recess 9 and an inner channel (not shown) for connecting the airhead channel 6 with the scavenging ducts 3 during the piston 13 reciprocal movement in a particular phase. Note, as well, an additional difference is that the airhead channel 6 includes a pair of rubber tubes, each tube extending from the air inlet 2 to a corresponding air inlet port 7, which it is connected to a corresponding connecting tube 34.

As best seen in FIGS. 1-2, the air inlet ports 7 are disposed in the cylinder wall 12 vertically below exhaust part 20. Their vertical location determines whether or not the exhaust gases are in contact or fluid communication with the air inlet ports 7 and, therefore, possibly the airhead channel 6. As noted, the air inlet ports 7, in the embodiments of FIGS. 1 and 2, have been moved vertically downward with respect to exhaust port 20 so that they do not come in contact with the exhaust gases at all when the piston is at its bottom dead center. Instead, the piston 13 seals off the air ports 7 so that such a connection does not occur. When the air inlet ports 7 are lowered in the cylinder wall 12, the flow paths formed by the piston two recesses 9 is given increased height in the longitudinal axial direction of the piston 13. The flow paths formed by the piston two recesses 9 are intended to be a fluid connection between the fuel and air inlet channel 22 and the respective top ports 31*a* of the scavenging ducts 3, when the piston 13 passes the port 23 and thus fluidly connects the channel 22 and the scavenging ducts 3 leading a part of the fuel and air mixture into the combustion chamber 32 in the shortest way which is illustrated in FIG. 3.

As shown in FIGS. 1 and 2, the piston 13 is shown in a location adjacent to an absolute top dead center position. The piston position shown is characterized by the fuel and air inlet port 23 is being opened to the crankcase 16. When the piston 13 moves downwards, the communication between the airhead channel 6 and the scavenging ducts 3 will, however, be established by way of the channels (not shown) made within the piston 13 when they match the ports 7. When the piston 13 moves further downwards and the recesses 9 match the port 23, the fuel and air mixture is fed into the scavenging channels 3 via recesses 9 and further into the combustion chamber 32. The underpressure in the crankcase 16 is consequently at its maximum during this initial opening, and subsequently starts to diminish as the connection between the fuel and air inlet channel 22 and the crankcase 16 is established at the piston 13 movement upwards. The embodiment of engine 10 shown in FIG. 3 differs only from the previously discussed embodiment shown in FIGS. 1 and 2 having the crossover channel 40 for a fluid connection of the airhead channel 6 and the fuel and air mixture inlet channel 22 in that a single piston recess 9 for directing the fuel and air mixture from the fuel and air inlet channel 22 to the pair of scavenging ducts 3. Rather, or a pair of piston recesses 9 is provided in the outer wall of the piston 13, the recesses 9 being separated by a wall section 35 of the piston 13. Note, however, the circumferential length of the wall section 35 is less than the circumferential length or width of the fuel and air inlet port 23 of the fuel and air inlet channel 22. As such, the fuel and air mixture inlet channel 22 is intermittently in fluid communication with each scavenging duct 3 by way of its corresponding piston recesses 9 when the piston 13 passes the port 23.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

The invention claimed is:

1. A scavenging two-stroke internal combustion engine, comprising:

a cylinder with a cylinder wall defining a combustion chamber;

a piston reciprocally disposed within the cylinder;

a crankcase including a crankshaft rotatably disposed therein, the piston being connected to the crankshaft by a connecting rod;

at least one scavenger duct extending between the combustion chamber and the crankcase, the scavenger duct including a top port and a bottom port;

a fuel and air mixture inlet channel connected to a carburetor having a throttle valve, the fuel and air inlet mixture channel being in fluid communication with the crankcase by way of a fuel and air inlet port so that the fuel and air mixture inlet channel delivers a fuel and air mixture to the crankcase; and an airhead channel opening into the cylinder, the airhead channel comprising an air inlet valve, wherein the airhead channel and the fuel and air mixture inlet channel are formed separately one from another, wherein at least at startup of the engine the air inlet valve is a closed position and fluid communication is established between the fuel and air mixture inlet channel and the combustion chamber via a crossover channel extending between the fuel and air mixture inlet channel and the airhead channel thereby leading a part of the fuel and air mixture into the combustion chamber, the crossover channel being disposed in a sidewall of the cylinder downstream of the throttle valve and the air inlet valve.

2. The internal combustion engine of claim 1, wherein the crossover channel delivers the fuel and air mixture to the combustion chamber via the airhead channel.

3. The internal combustion engine according to claim 2, wherein an idle start valve is disposed in the crossover channel, the idle start valve being movable between an open position in which the fuel and air mixture inlet channel is in fluid communication with the airhead channel and a closed position in which the fuel and air inlet channel is isolated from the airhead channel.

4. The internal combustion engine according to claim 3, wherein the idle start valve is in the open position only during the startup of the engine, when the air inlet valve is in the closed position.

5. The internal combustion engine of claim 1, wherein the crossover channel comprises an idle start valve, and wherein in response to the air inlet valve being in the closed position at the startup of the engine, the throttle valve is configured to be in an idle position, and the idle start valve being configured to be in an open position to lead a part of the fuel and air mixture entering from the carburetor through the fuel and air mixture inlet channel into the combustion chamber.

6. The internal combustion engine of claim 1, wherein at least a portion of the airhead channel and the fuel and air mixture inlet channel are separated from each other via the sidewall of the cylinder.

7. The internal combustion engine of claim 6, wherein an interior surface of the cylinder wall defines a combustion chamber.

8. A method of starting an internal scavenging two-stroke combustion engine, the engine including a cylinder with a cylinder wall defining a combustion chamber, a crankcase, and a piston disposed in the cylinder, the method comprising:

providing a fuel and air mixture inlet channel in fluid communication with the crankcase, the fuel and air mixture inlet channel being connected to a carburetor having a throttle valve;

providing an airhead channel in fluid communication with an interior of the cylinder, the airhead channel comprising an air inlet valve, wherein the airhead channel is formed separately from the fuel and air mixture channel; and providing a crossover channel downstream of the throttle valve and the air inlet valve in a sidewall of the cylinder between the fuel and air mixture inlet channel and the airhead channel, wherein in response to the air inlet valve being in a closed position during startup of the engine, establishing fluid communication between the air and fuel mixture inlet channel and the combustion chamber via the crossover channel thereby leading a part of the fuel and air mixture into the combustion chamber.

9. The method according to claim 8, wherein establishing fluid communication between the air and fuel mixture inlet channel and the combustion chamber via the crossover channel comprises delivering the fuel and air mixture to the combustion chamber from the air and fuel mixture inlet channel via the crossover channel through the airhead channel.

10. The method according to claim 9, wherein providing the crossover channel comprises providing an idle start valve in the crossover channel, wherein when the idle start valve is in an open position, fluid communication is established between the air and fuel mixture inlet position, and wherein when the idle start valve is in an closed position, the fuel and air inlet channel is isolated from the airhead channel.

11. The method according to claim 10, wherein the idle start valve is in the open position only when the air inlet valve is in the closed position.

12. The method according to claim 8, wherein providing the crossover channel comprises providing the crossover channel comprising an idle start valve, and wherein in response to the air inlet valve being in the closed position at the startup of the engine, the throttle valve is in an idle position, and the idle start valve is an open position leading the part of the fuel and air mixture entering from the carburetor through the fuel and air mixture inlet channel into the combustion chamber.

13. The method according to claim 12, wherein operation of the idle start valve is tied directly to operation of the throttle valve.

14. The method according to claim 8, wherein establishing fluid communication between the air and fuel mixture inlet channel and the combustion chamber via the crossover channel comprises delivering the fuel and air mixture to the combustion chamber from the air and fuel mixture inlet channel via the crossover channel through the airhead channel such that the fuel and air mixture passes directly into at least one scavenger duct thereby bypassing the crankcase.

15. A scavenging two-stroke internal combustion engine, comprising:

a cylinder with a cylinder wall defining a combustion chamber;

a piston reciprocally disposed within the cylinder;

a crankcase including a crankshaft rotatably disposed therein, the piston being connected to the crankshaft by a connecting rod;

at least one scavenger duct extending between the combustion chamber and the crankcase, the scavenger duct including a top port and a bottom port;

a fuel and air mixture inlet channel in fluid communication with the crankcase by way of a fuel and air inlet port so that the fuel and air mixture inlet channel delivers a fuel and air mixture to the crankcase; and an airhead channel opening into the cylinder, the airhead channel comprises an air inlet valve, wherein the airhead channel and the fuel and air mixture inlet channel are formed separately one from another, wherein at least at startup of the engine, fluid communication is established between the fuel and air mixture inlet channel and the combustion chamber via a pair of recesses formed on an outer wall of the piston leading a part of the fuel and air mixture into the combustion chamber, the pair of recesses being separated from each other by a wall section of the piston.

16. The internal combustion engine of claim 15, wherein the pair of recesses extend radially inward from the outer surface of the piston and provide the fluid communication between the fuel and air mixture inlet channel and the combustion chamber as the piston reciprocates within the cylinder.

* * * * *